United States Patent [19]

Tichy et al.

[11] Patent Number: 4,586,430

[45] Date of Patent: May 6, 1986

[54] PRESS FOR EXTRACTING JUICE FROM COMESTIBLE SOLIDS AND SEMI-SOLIDS SUCH AS FRUIT AND VEGETABLES

[75] Inventors: Oldrich J. Tichy, Concord; Konrad E. Meissner, Lafayette, both of Calif.

[73] Assignee: Atlas Pacific Engineering Company, Emeryville, Calif.

[21] Appl. No.: 662,676

[22] Filed: Oct. 19, 1984

Related U.S. Application Data

[63] Continuation-in-part of Ser. No. 514,099, Jul. 15, 1983, which is a continuation-in-part of Ser. No. 509,865, Jun. 30, 1983, abandoned.

[51] Int. Cl.[4] ..... B30B 9/24; B30B 9/26

[52] U.S. Cl. ..... 100/118; 100/116; 100/130; 100/131; 99/425; 99/444

[58] Field of Search ..... 100/118, 119, 120, 211, 100/269 A, 130, 131, 132, 134, 135, 136, 116, 110, 105, 106, 107, 109; 99/425, 444, 445, 446

[56] References Cited

U.S. PATENT DOCUMENTS

| | | | |
|---|---|---|---|
| 214,207 | 4/1879 | Tiffany | 100/116 X |
| 262,702 | 8/1882 | Sears et al. | 100/130 X |
| 782,406 | 2/1905 | Mayhew et al. | 100/130 |
| 2,931,290 | 4/1960 | Davidson | 100/118 X |

*Primary Examiner*—Peter Feldman
*Attorney, Agent, or Firm*—Ernest M. Anderson

[57] ABSTRACT

A press for extracting juice from comestible solids and semi-solids such as fruit and vegetables which includes a sectionalized stationary perforated platen, a juice pervious conveyor belt for carrying comminuted comestible into pressing position over that platen, a feeder for forming a series of separated non-continuous beds of comminuted comestible upon the belt, a rotary drive moving the belt incrementally to position each bed of comestible in sequence over the stationary platen and a pressing platen which has a pressing cavity overlying the stationary platen defined by a depending sealing flange circumscribing the bed of comestible and a flexible membrane within the cavity that can be expanded into pressing engagement with the bed by pneumatic pressure in order to press juice from the comestible for drainage through the juice pervious belt and perforated stationary platen into a juice collection pan.

6 Claims, 20 Drawing Figures

PRESS FOR EXTRACTING JUICE FROM COMESTIBLE SOLIDS AND SEMI-SOLIDS SUCH AS FRUIT AND VEGETABLES

This application is a continuation-in-part of application Ser. No. 514,099 filed July 15, 1983 entitled "Press for Extracting Juice From Comestible Solids and Semi-Solids such as Fruits and Vegetables" which is a continuation-in-part of application Ser. No. 509,865 filed June 30, 1983 entitled "Press For Extracting Juice From Comestible Solids and Semi-Solids such as Fruits and Vegetables," now abandoned.

BACKGROUND OF THE INVENTION

Heretofore fruits and vegetables or a pulp made from them have been physically pressed between fixed platens, or a fixed platen and an expandable pneumatic press bag to squeeze juice from the fruit, vegetable or pulp. The article entitled "Automatic Pneumatic Press" appearing at page 31 of Vines and Wines, December, 1960, describes such a press having fixed platens and an expandable pneumatic press bag to press juice from a continuous bed of comestible that is carried between the platens by a conveyor belt.

BRIEF DESCRIPTION OF THE INVENTION

This invention is a press which includes a movable pressing platen for circumscribing and pressing by means of an expandable, flexible membrane, a non-continuous bed of comestible conveyed over a fixed perforated platen by a juice pervious belt.

A principal object of the invention is to provide a juice extraction press of modular design which can be one of a series operating at different pressing pressures to practice the process disclosed and claimed in copending application Ser. No. 406,088 filed Aug. 6, 1982, by Oldrich J. Tichy and Konrad E. Meissner entitled "Pressing Method for Extracting Liquid from Comestibles such as Fruits and Vegetables", now abandoned.

Another object of the invention is to provide a press that employs an inexpensive expandable flat membrane, rather than a more complex and expensive pneumatic bag as the active pressing means.

One other object of the invention is to provide a movable pressing platen that carries the expandable membrane within a pressing cavity that is defined by the membrane and by a seal flange that circumscribes a non-continuous bed of comestible during the pressing operation.

Still another object of the invention is a feeder which gates onto the conveyor belt, a non-continuous bed of comestible equivalent in top surface area to the pressing area of the membrane.

An object of the invention also is to provide an enclosed juice collection system to reduce oxidation of the expressed comestible juice.

A still further object is to provide a juice collection system including a sectionalized platen to enhance cleaning and maintenance of equipment.

Other objects and advantages of the invention will become apparent upon consideration of the following description of a preferred embodiment of the press and of the accompanying drawings.

DESCRIPTION OF A PREFERRED EMBODIMENT

Figure 1:
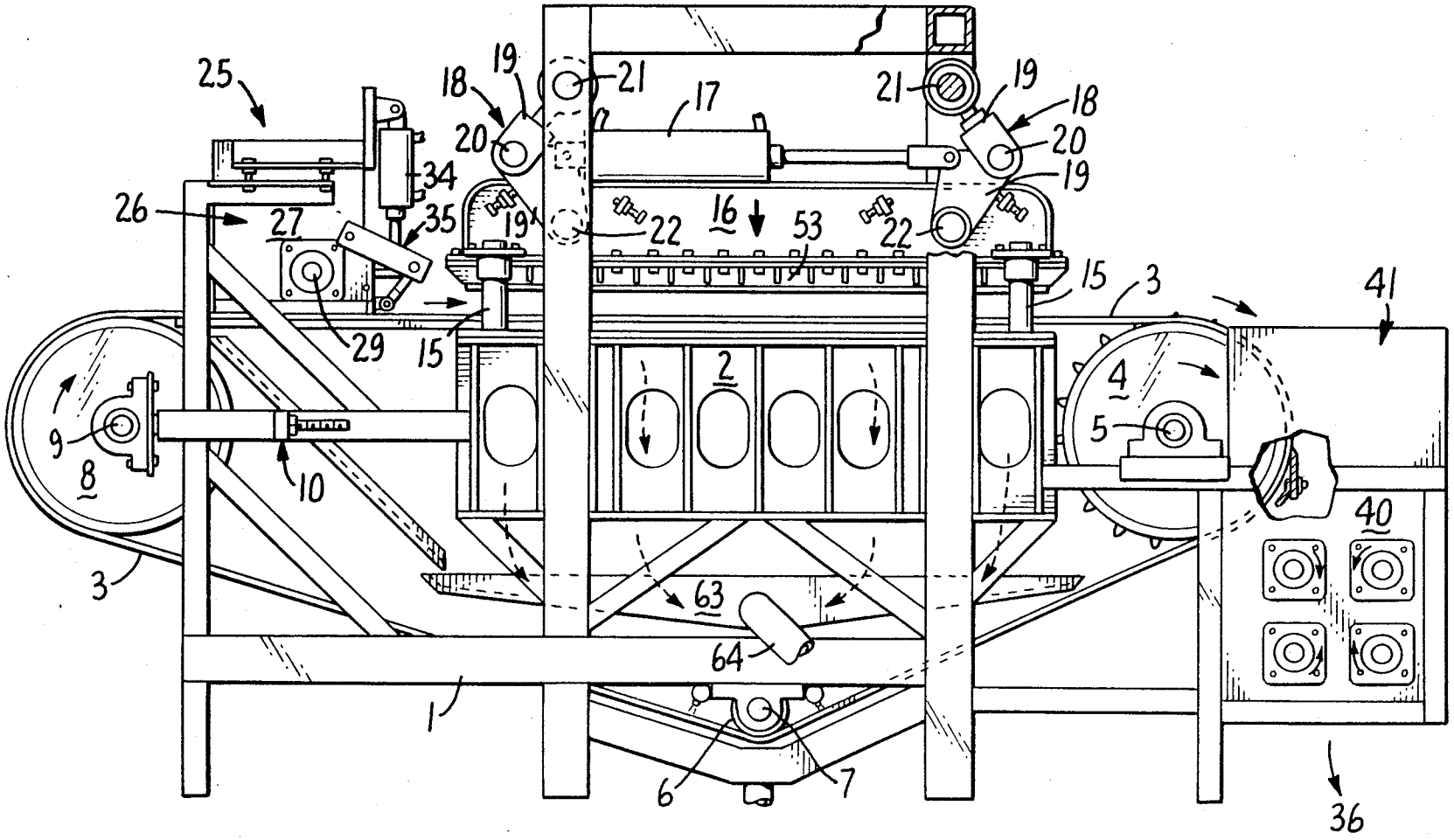
FIG. 1 is a side elevational view of the press.

The press includes a rigid frame referred to generally as 1 upon which mounts a stationary perforated platen referred to generally as 2. A juice pervious conveyor belt 3 travels over the stationary platen 2 in the direction of the arrows shown on FIG. 1. The belt 3 trains over toothed drive drum 4 mounted on the frame in journal bearings 5, smoothsurfaced idler roll 6 journaled in bearings 7 also mounted upon the frame and a toothed take-up idler drum 8 mounted in journal bearings 9 adjustably mounted to the frame by means of a pair of take-up nut and bolts referred to at 10.

Also mounted on the frame 1 and slidable on four guide posts 15 is a movable pressing platen referred to generally as 16. The pressing platen 16 overlies the conveyor belt 3 and its underlying stationary platen 2. It is movable vertically by a pair of hydraulic cylinders 17 each of which actuate a pair of scissor mechanisms 18 at each end of the pressing platen. The scissor mechanisms each comprise a pair of links 19 pinned together on the axis of cylinder 17 at 20 with one link of each pair pinned at 21 to the frame 1 and the other link pinned at 22 to the movable pressing platen 16, itself. The uppermost position of the pressing platen 16 is shown in FIGS. 1, 3 and 4. Its lowermost position is shown in FIG. 5.

Comminuted comestible material for pressing flows at 25 into a feeder referred to generally as 26 overlying the conveyor belt 3 between the take-up drum 8 and the platens 2, 16. Comestible material distributes into feeder 26 from an oscillating conveyor or other means, not shown. The feeder 26 includes a hopper 27 with a gated opening 28 shown in FIG. 3 through which comestible discharges in a bed 30 upon the moving conveyor belt 3 traveling in the direction of the arrows in FIGS. 1 and 3. Feeder rotor 29 having a plurality of straght rods 31 driven by gearhead motor 32 moves comestible material to the gate opening 28 and out onto the traveling belt 3. A slidable gate door 33 manipulated by hydraulic cylinder 34 and a pivoted linkage referred to generally as 35 moves the gate door 33 upwardly to provide the gate opening 28 and moves the gate door downwardly to close it. The lower edge of the gate door 33 controls the height of the bed 30 of comestible that deposits upon the belt. This height may be adjusted by controlling the stroke of the cylinder 34 or linkage 35.

Figure 2:
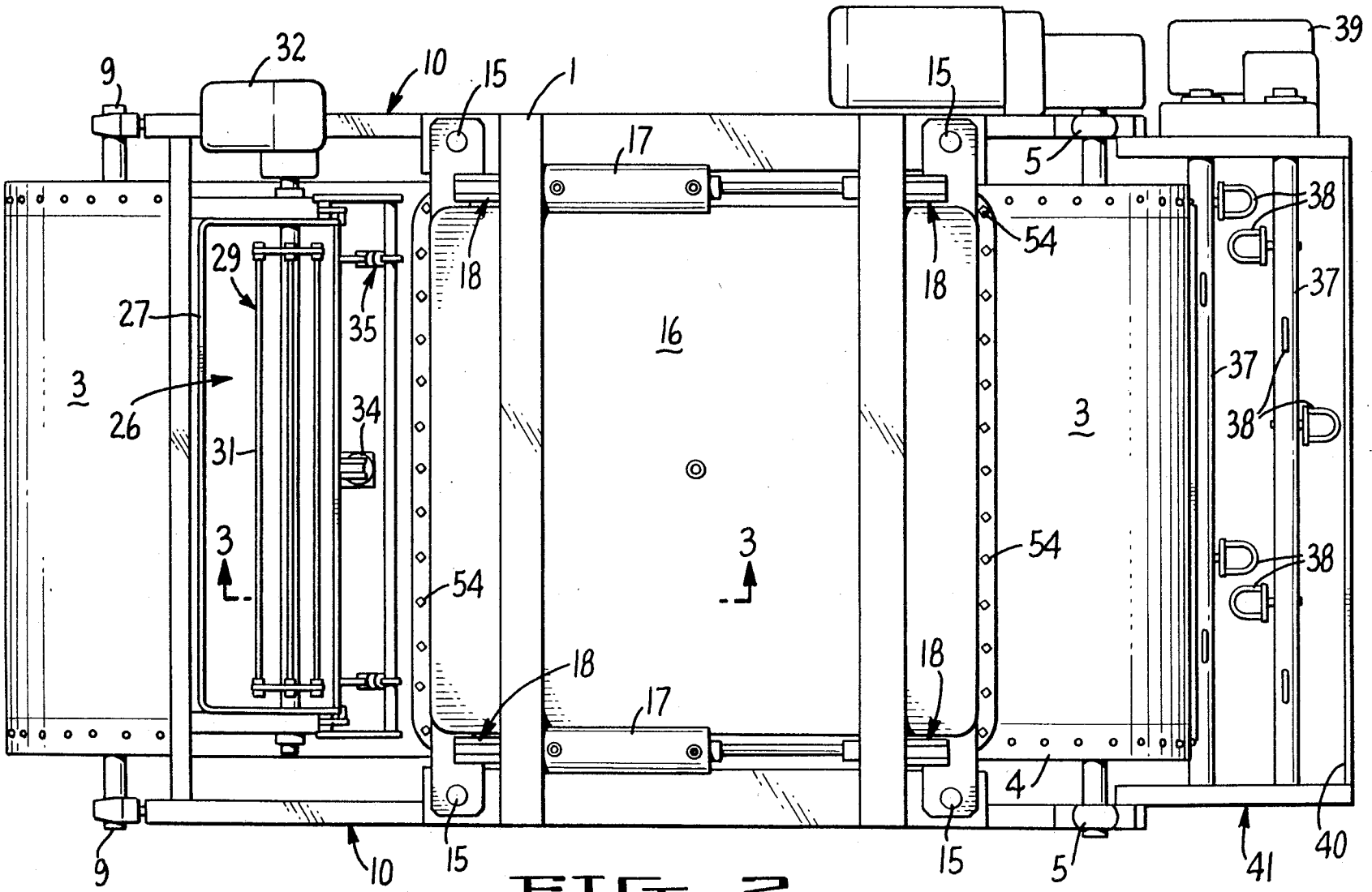
FIG. 2 is a top plan view of the press.
Figures 3, 4, 5:
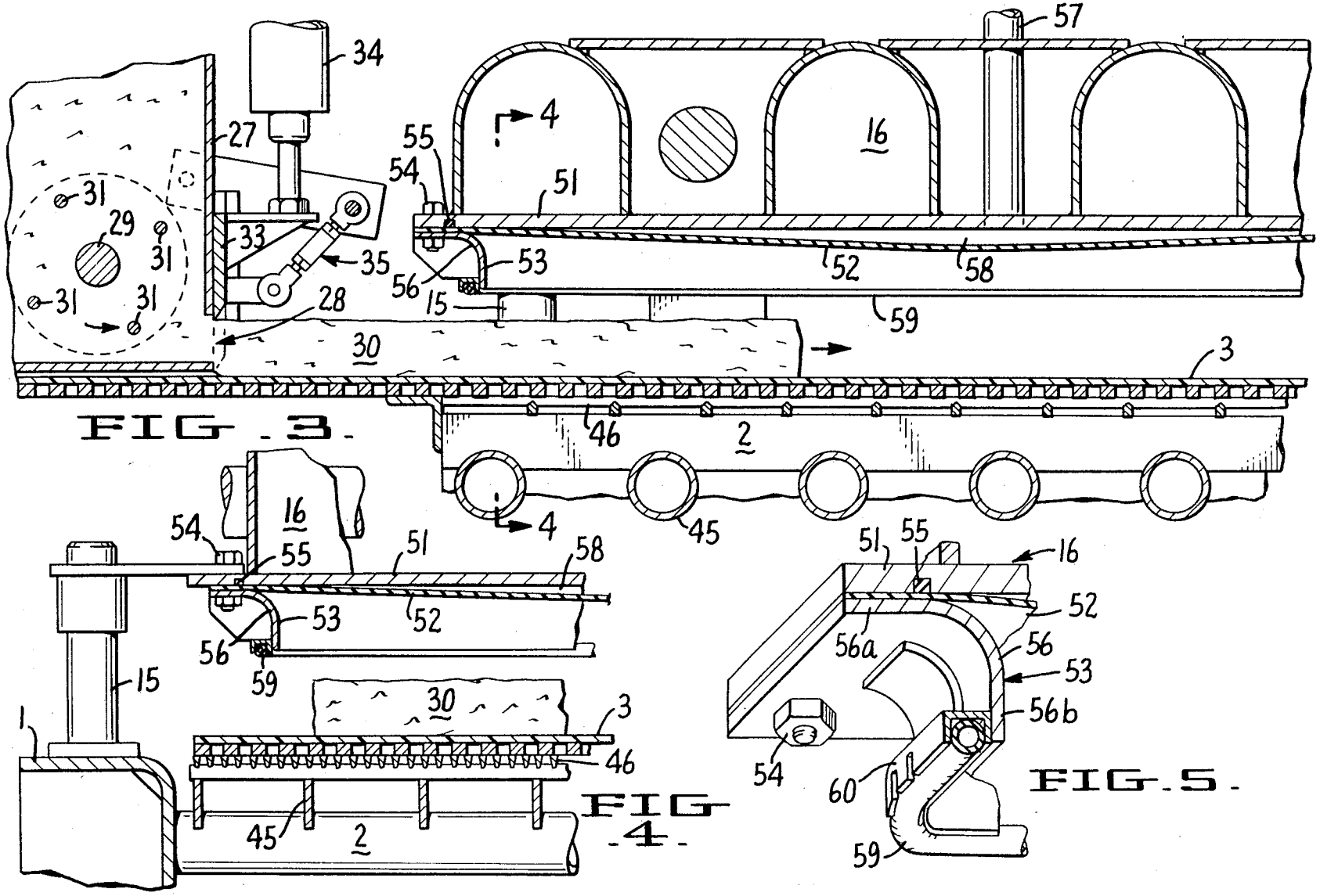
FIG. 3 is a partial vertical sectional view through the feeder and a portion of the belt and platens taken along line 3—3 of the FIG. 2.
FIG. 4 is an enlarged vertical sectional view of the belt and platens taken along line 4—4 of FIG. 3.
FIG. 5 is a partial perspective view partly in section of the depending sealing flange of the movable platen.
Figure 6:
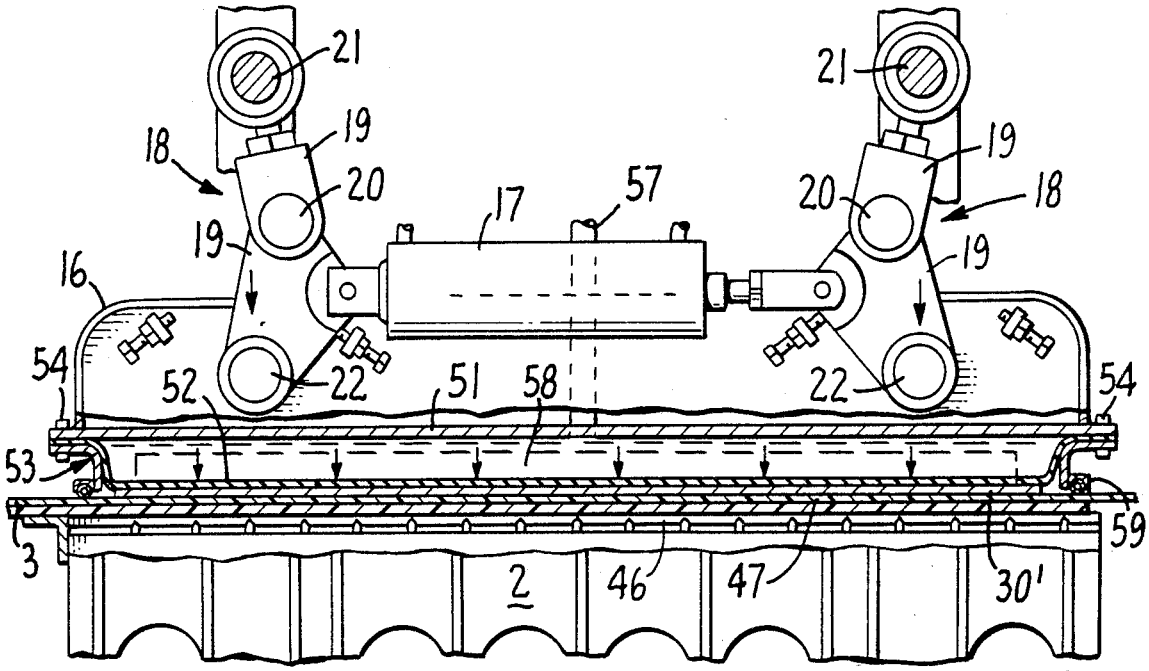
FIG. 6 illustrates one form of lift mechanism for the movable platen in side elevation partly in section.
Figure 8:
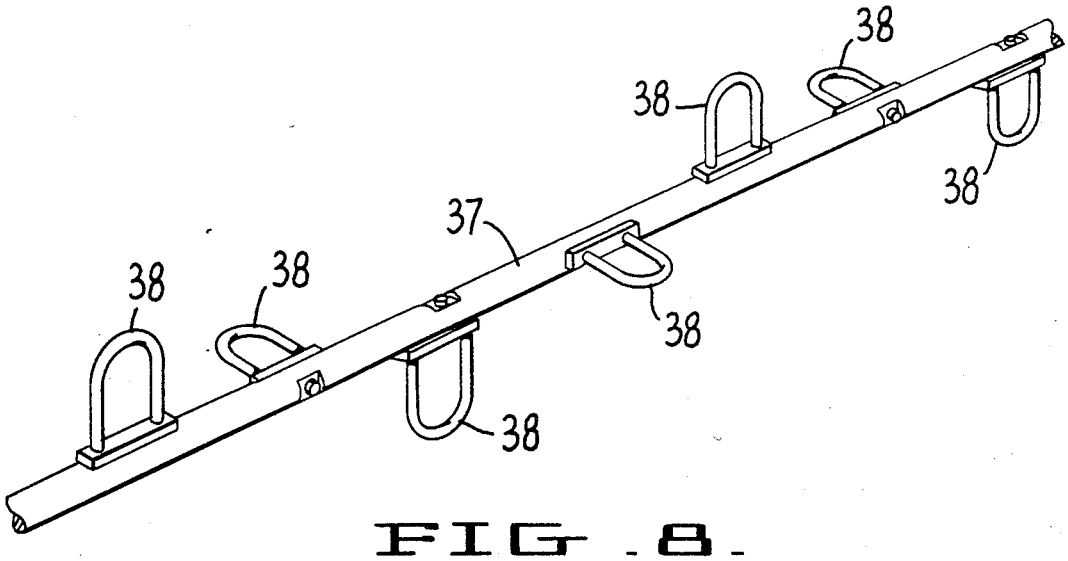
FIG. 8 illustrates the mixer bar and paddle construction.

A multiple paddle mixer 41 at the discharge end of the belt 3 shown in FIGS. 1 and 2 receives the pressed comestible cake 30′ shown in FIG. 5 and breaks it back into particles for discharge through the open bottom at 36 into subsequent processing stages such as those illustrated in co-pending application Ser. No. 406,088 filed Aug. 6, 1982, by Oldrich J. Tichy and Konrad E. Meissner entitled "Pressing Method for Extracting Liquids from Comestibles such as Fruits and Vegetables". This mixer 41 in the described embodiment as more clearly is illustrated in FIGS. 2 and 8 comprises four paddle rods 37 carrying spaced paddles 38 that are continuously rotated from a common drive motor 39 in counter-rotating directions within the mixer hopper 40.

Figure 7:
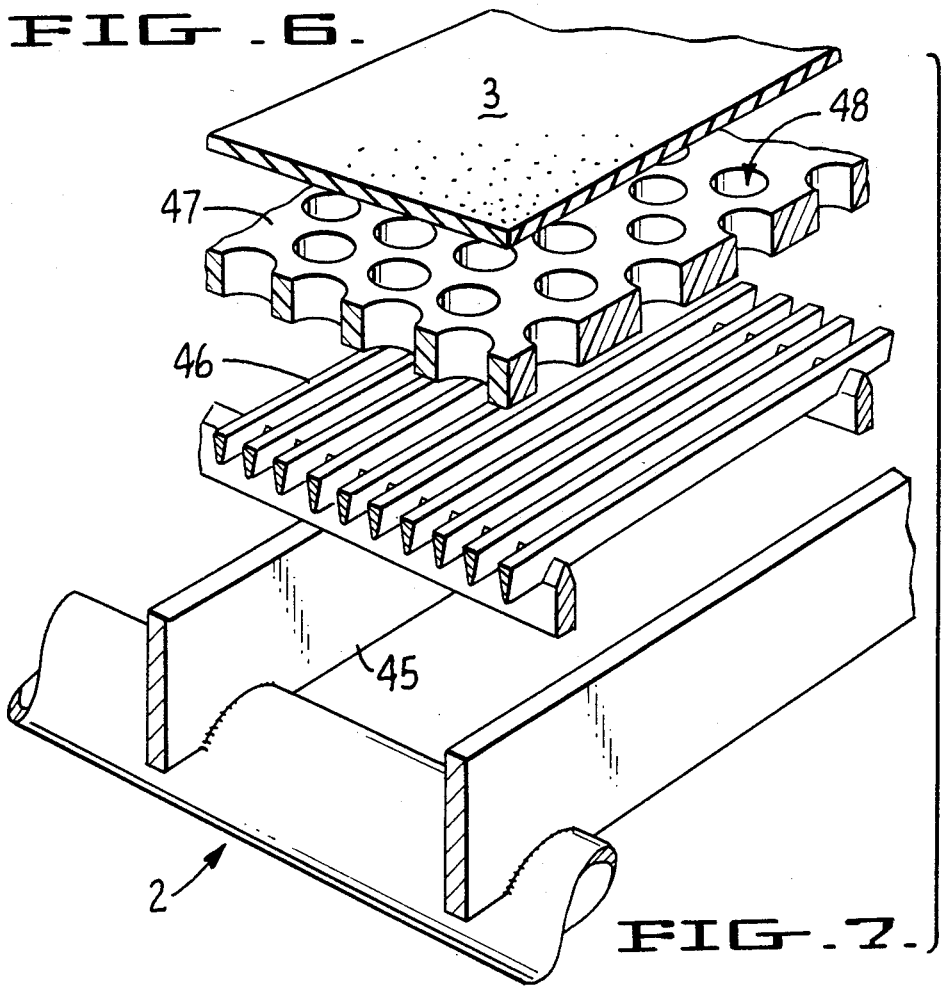
FIG. 7 is an exploded view of the fixed platen construction and a portion of the overlying conveyor belt.

As illustrated, the stationary platen 2 is a rigid weldment fabricated from structural steel members and stiffened to withstand the pressing forces that are exerted upon it. Overlying the structural steel members illustrated in the exploded view of FIG. 7 and in FIG. 3 generally as 45 is a grid of closely spaced bars 46 arranged longitudinally with respect to the belt travel. These stainless steel bars 46 rest upon thestructural steel members 45 of the stationary platen 2. Overlying the bars 46 is a sheet of ultra-high molecular weight polyethylene or similar material, perforated with approximately ½ inch diameter holes so its surface area is about 50% open. The juice pervious belt 3 in the described embodiment may be made fom metal or plastic mesh. In the described embodiment the belt has open spaces or perforations in the range of 0.020–0.030 inches in diameter.

The movable pressing platen 16 in the described embodiment also is a weldment fabricated from structural steel members as is more clearly shown in FIGS. 3, 4 and 5. The structural steel members stiffen the pressing platen face plate 51 which has secured to its lower surface the expandable pressing membrane 52 by means of depending sealing flange 53 secured to the face plate 51 around its periphery by a plurality of nuts and bolts 54 to hold the membrane securely between face plate 51 and sealing flange 53. The membrane is flat rubber sheet. The sealing flange 53 and membrane 52 define a pressing cavity which, with belt 3, completely encloses each separated bed 30 of comestible as it is pressed. The sealing flange has a curved radius 56 connecting horizontal leg 56*a* through which bolts 54 pass and depending vertical leg 56*b*. The flexible membrane deflects around radius 56 as it expands into the pressing position shown in FIG. 5.

An air-tight seal between the flexible pressing membrane 52 and platen face plate 51 is formed around the flange periphery by a hard rubber gasket 55 carried in a groove formed in face plate 51 and pressed beneath sealing flange horizontal leg 56*a*. Air under pressure is communicated through a central conduit 57 to the space 58, shown in FIG. 3, between platen face plate 51 and membrane 52 to expand the pressing membrane within the pressing cavity into pressing engagement with the comestible bed 30. In the described embodiment, air pressures in the range of 20 to 90 psi gauge pressure are used. The lower end of leg 56*b* of the sealing flange 53 carries a continuous resilient rubber seal 59 retained in a channel 60. The seal 59 is approximately 2 inches below the platen face plate 51 in the described embodiment for pressing a bed 30 of comestible gated out of the feeder 26 at approximately 2 inches in height.

Comestible to be pressed is moved from the feeder 26 by its rotor bars 31 that continuously move at the same peripheral velocity as the conveyor belt 3 during the feeding operation. Gate door 33 in its upward retracted position shown in FIG. 3 opens the gate opening 28 and controls the height of the comestible bed 30 as the rotor spreads the comminuted comestible on the traveling belt. In the described embodiment, the rotor bar peripheral velocity and the belt velocity are about 6 inches per second.

Figure 9:
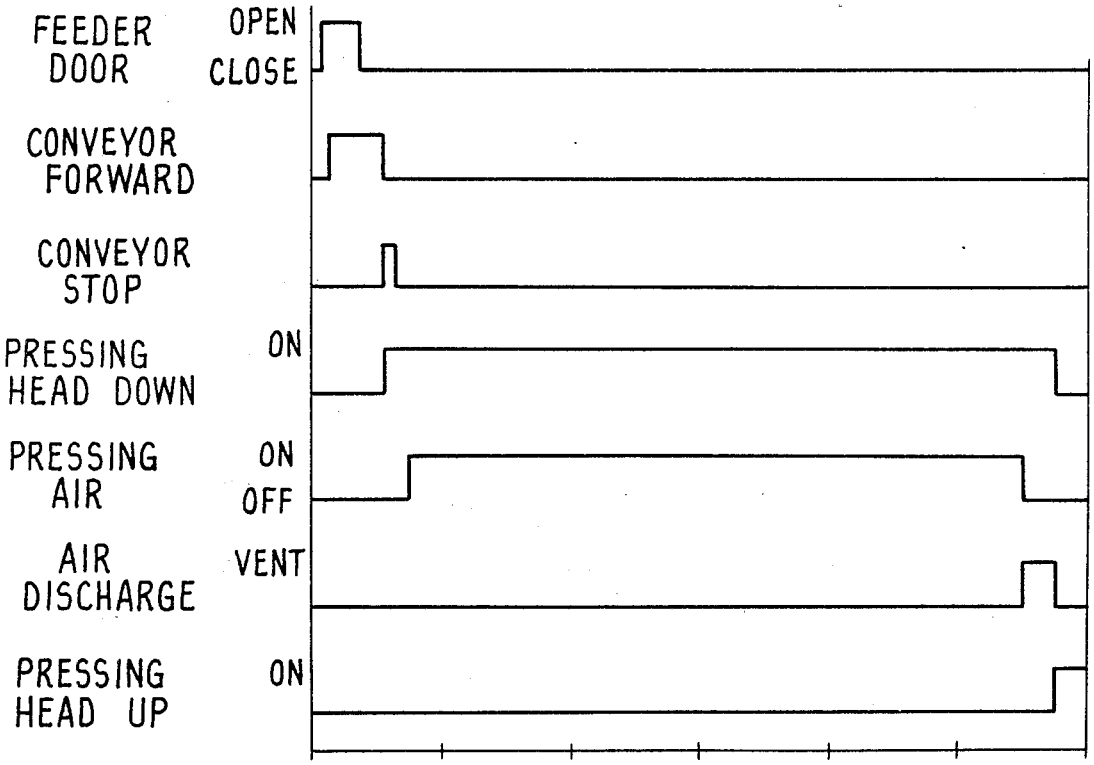
FIG. 9 illustrates the timing sequence of the various parts of the press.

FIG. 9 illustrates the timed relationship of the various press components. In sequence, the feeder door 33 opens and simultaneously the conveyor belt 3 commences its forward travel until a bed 30 of comestible is laid upon the belt which approximates the length of the moving pressing platen 16 in the direction of belt travel. The feeder door 33 then closes but conveyor belt 3 moves forward until the non-continuous bed 30 is directly below the movable pressing platen 16 and over the stationary platen 2 at which time belt travel stops. The pressing platen 16 moves downwardly into the pressing position shown in FIG. 5. Shortly after the pressing platen starts its downward travel, pneumatic pressure is admitted through conduit 57 to expand the flexible membrane 52 into pressing engagement with the bed 30 which then is completely enclosed within the pressing cavity formed by the membrane and the depending flange 53 that circumscribes the bed and with seal 59 pressed against the belt 30. The flexible membrane expands against the comestible bed as shown in FIG. 5 to compress it into a tightly packed cake 30′ and express the juice through the pervious belt, perforated plastic sheet 47, 48 and grid bars 46 into collecting pan 63 which underlies the open structure of the stationary perforated platen 2. The expressed juice is conveyed away for further processing through conduit 64.

At the end of the pressing operation shown in FIG. 5, the pressure in the space 58 between platen face plate 51 and flexible membrane 52 vents to atmosphere and the pressing platen 16 then moves upwardly with approximately a 4 inch travel to the position shown in FIG. 3. The foregoing feeder operation then repeats, while the pressed cake 30′ moves off the belt into mixer 41 and a new bed is spread upon the belt by feeder 26. Mixer 51 breaks up the pressed cake 30′ into particulate form for further processing in accord with the procedure outlined in the co-pending application Ser. No. 406,088 mentioned above.

Figure 12:
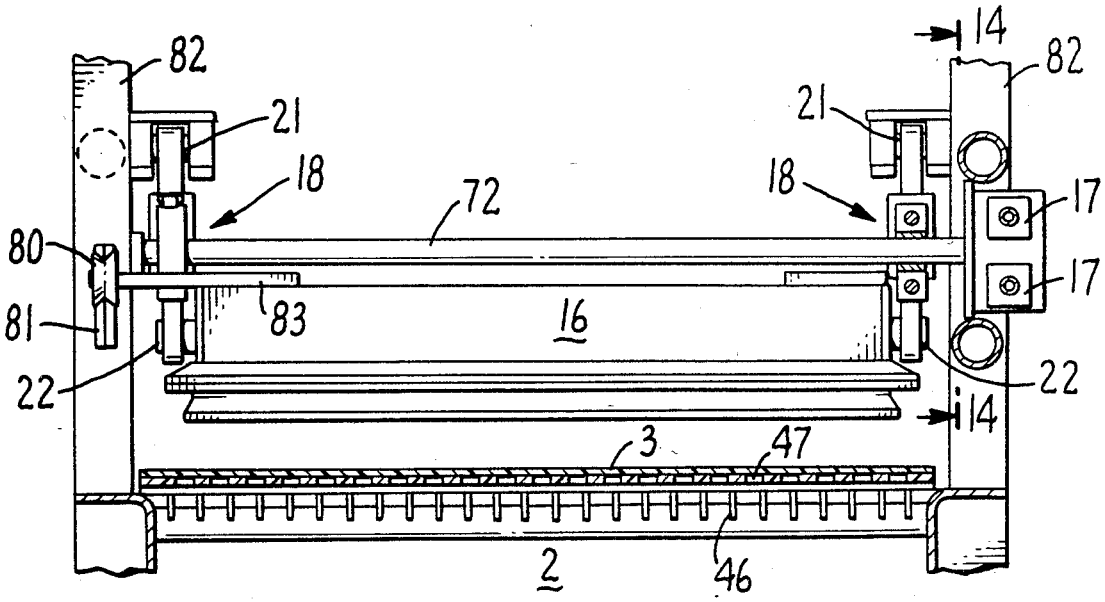
FIG. 12 is an elevational view of the pressing platen partially in section taken along line 12—12 of FIG. 10.
Figure 13:
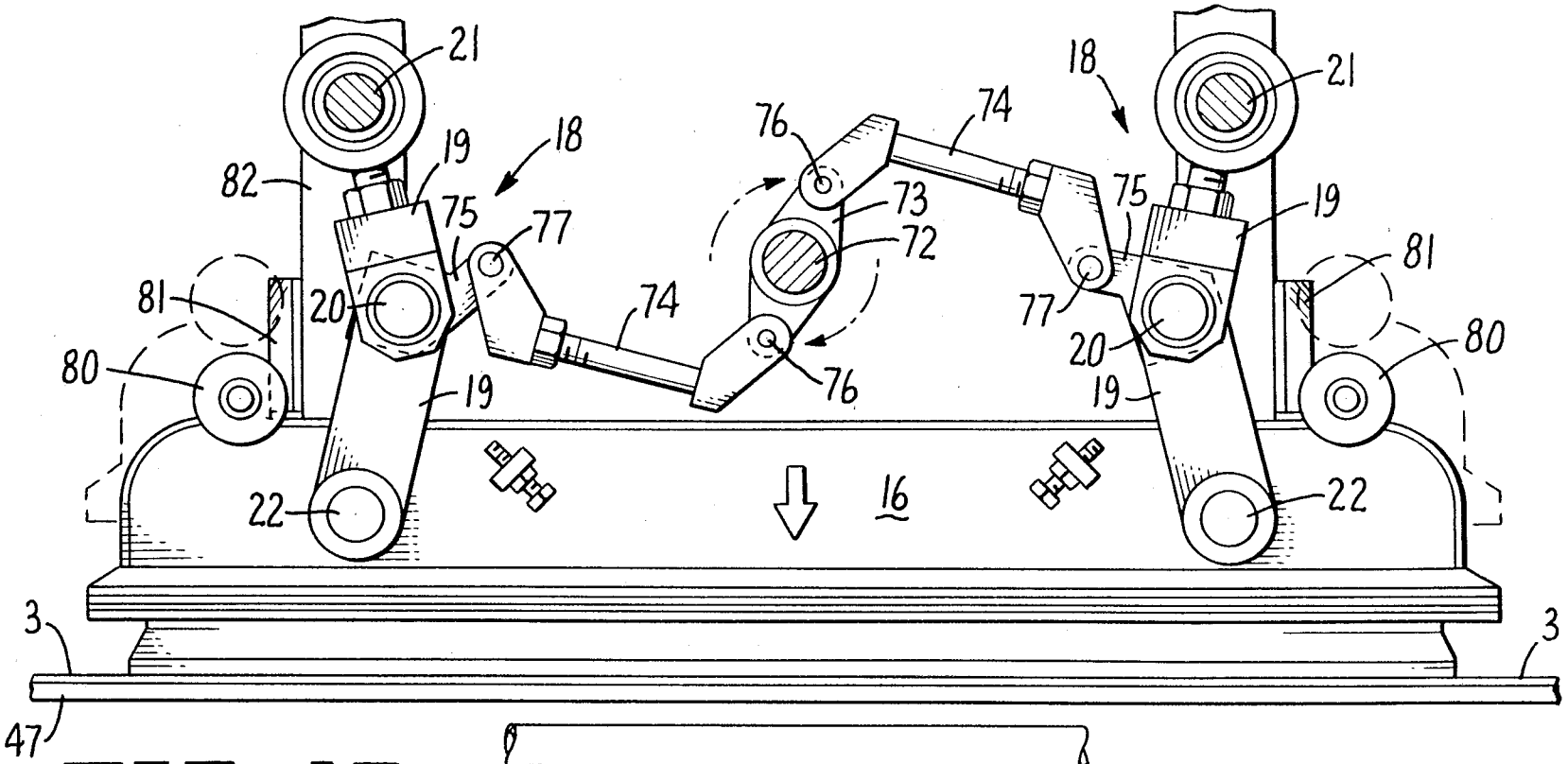
FIG. 13 is an enlarged elevational view of the modified means for raising and lowering the pressing platen shown in FIG. 10.
Figure 14:
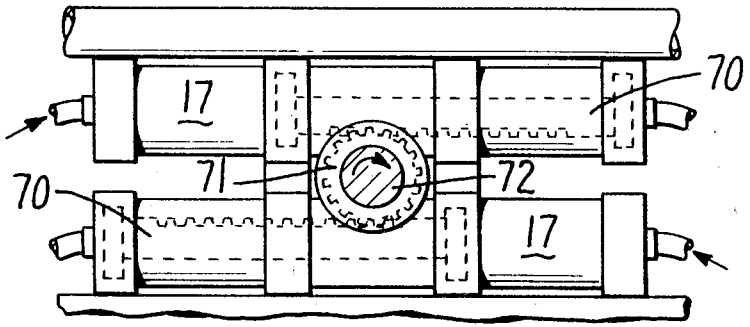
FIG. 14 is a side elevational view of the rack and pinion drive cylinders for the pressing platen taken along lines 14—14 of FIG. 12.
Figure 15:
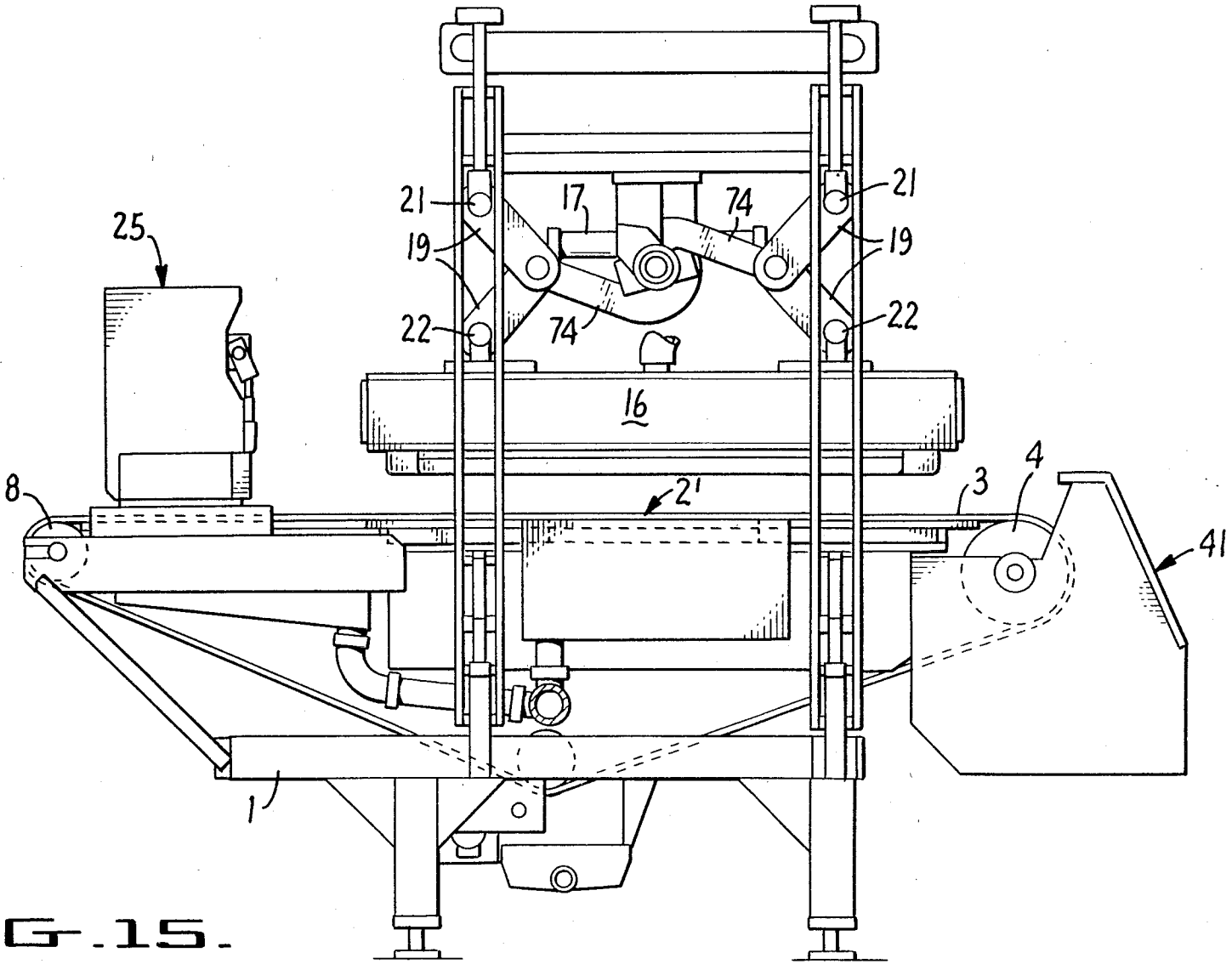
FIG. 15 is a side elevational view of the press and another embodiment of a support platen having a grooved bed and closed juice collection system.
Figure 16:
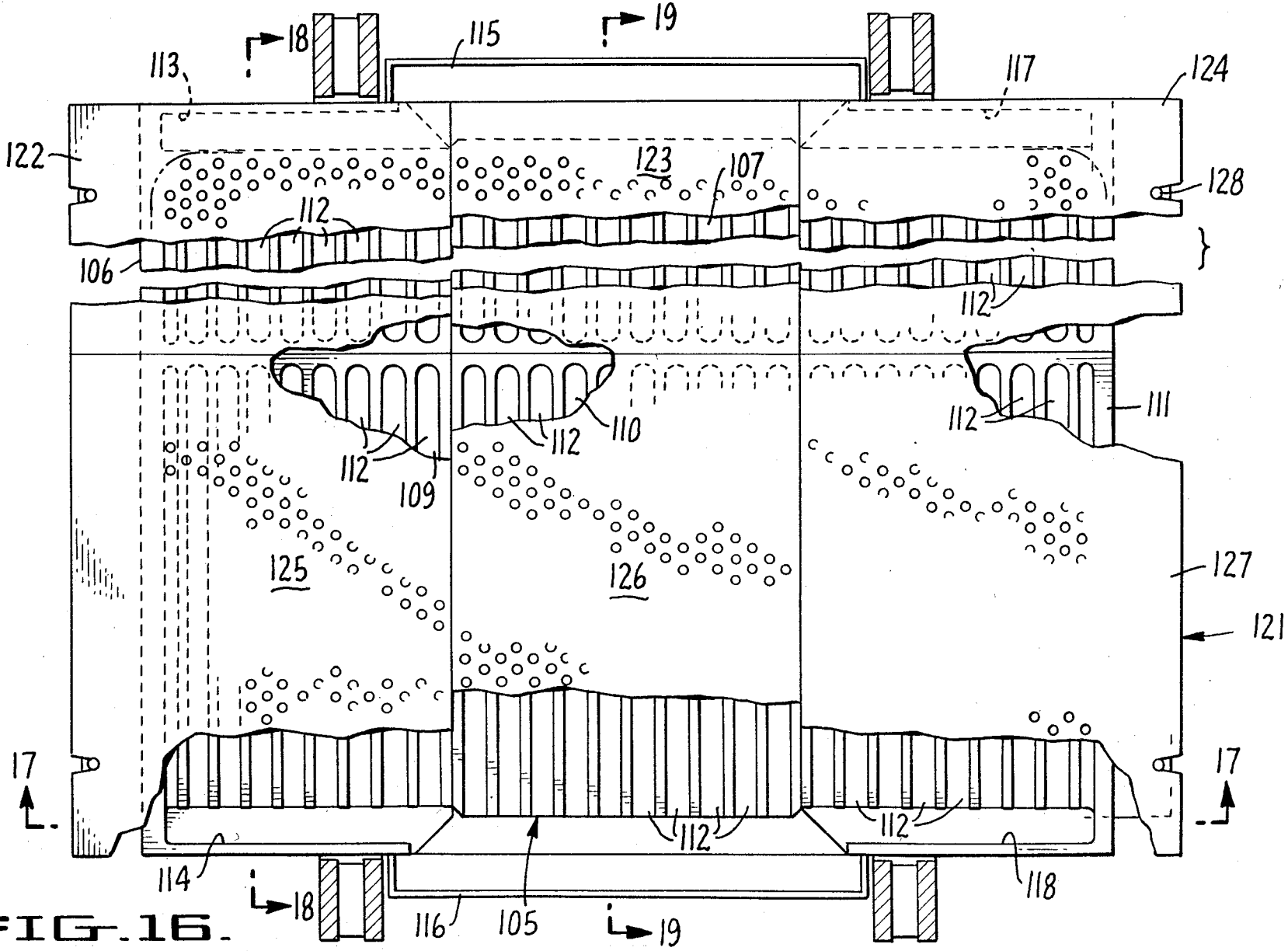
FIG. 16 is a plan view of the grooved bed of FIG. 15 with portions broken away to show the construction.
Figure 17:
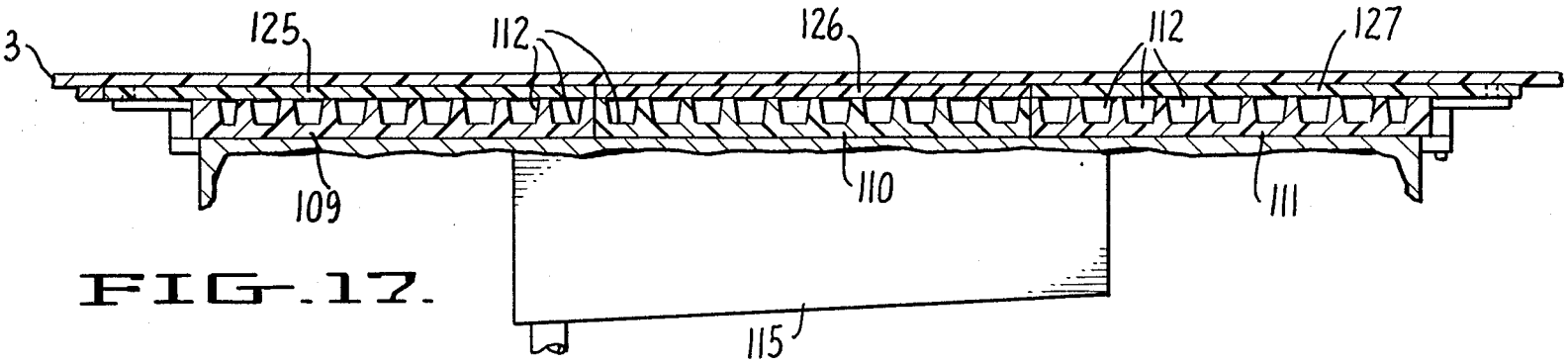
FIG. 17 is a sectional view of the bed taken along line 17—17 of FIG. 16.

FIGS. 10 and 12–14 illustrate an alternative drive mechanism for raising and lowering the pressing platen 16. As illustrated in FIGS. 10, and 12–14 a pair of hydraulic cylinders 17 mounted at one side of the frame 1, as shown in FIG. 12, actuate scissor mechanisms 18 at each corner of the pressing platen. The illustrated scissor mechanisms also each comprise a pair of links 19 pinned together at 20 with one link of each pair pinned at 21 to the frame 1 and the other link pinned at 22 to the movable pressing platen 16, itself. However, in this embodiment, each of cylinders 17 drives a piston mounted rack 70 in opposite directions to rotate rack pinion 71 mounted on drive shaft 72. The drive shaft 72 by means of crank 73 and links 74 each pinned at one end to crank 73 and at the other end to crank 75 by pins 76,77, respectively, simultaneously actuates all four of the scissors mechanism 18 to induce the scissoring action that moves the pressing platen 16 from its upper position shown in FIG. 10 to the lower position shown in FIG. 13. The pressing platen 16 tracks vertically upon the press frame 1 by means of four V-grooved rolls 80 that roll upon V-shaped tracks 81 mounted on frame vertical elements 82. The V-grooved rolls 80 mount in pairs upon shafts 83 at each end of the pressing platen 16.

Figure 10:
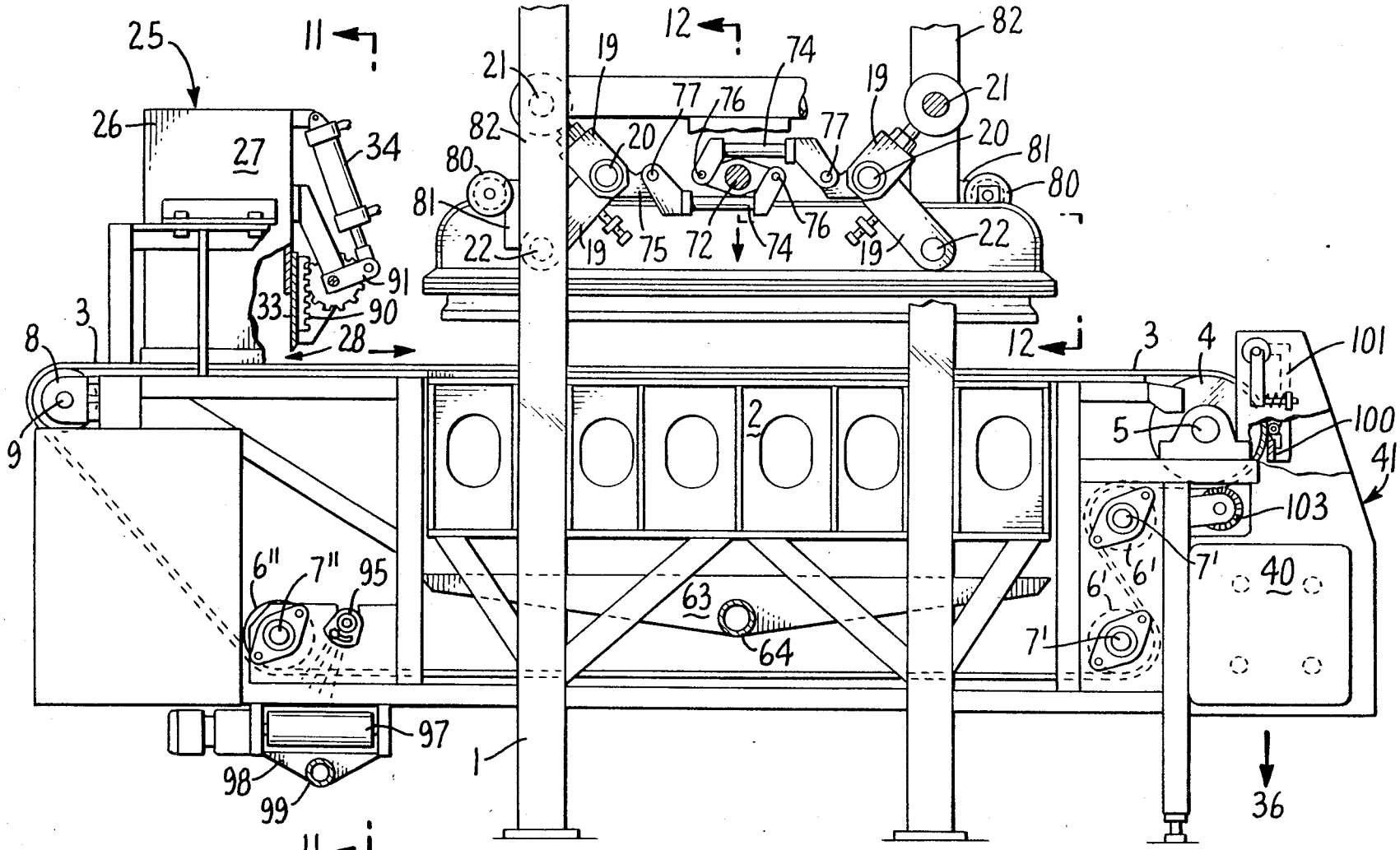
FIG. 10 is a side elevational view of the press having a rack and pinion drive means for raising and lowering the pressing platen and the slidable gate door.
Figure 11:
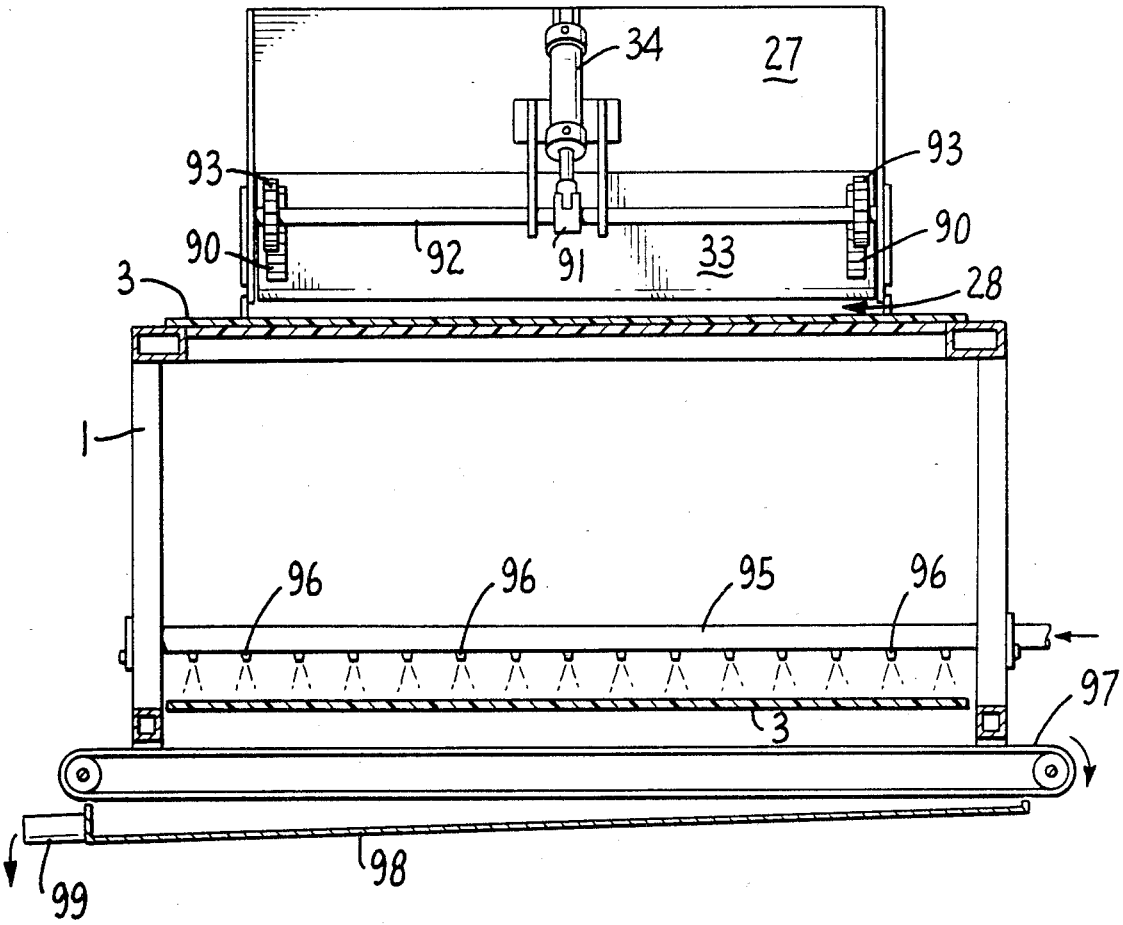
FIG. 11 is a vertical sectional view of the press along lines 11—11 of FIG. 10 illustrating the modified gate door drive and belt cleaning aspects of the invention.

The gated opening 28 of the feeder hopper 27 in the embodiment of FIGS. 10–11 is raised and lowered also by racks 90 mounted on the gate door 33. Hydraulic cylinder 34 through crank 91 rotates shaft 92 carrying a pinion 93 at each end to drive the racks 90 and thereby raise and lower the gate door 33, to control gated opening 28 as described in connection with the version shown in FIGS. 1–3.

In the embodiment of FIG. 10 the single idler roll 6 and its journal bearings 7 are replaced by three sets of idler rolls 6',6'' and their journal bearings 7',7''. Just prior to training over idler 6'' the belt 3 is exposed to a pressured water spray distributed across its width by distributor pipe 95 carrying a series of nozzles 96. Comestible debris washed off of the load-carrying side of the belt 3 drops onto the cross conveyor 97 for disposal or recycle. The wash water drains into basin 98 for disposal through conduit 99.

In the embodiment illustrated in FIG. 10, the pressed comestible cake is removed from the belt 3 by a spring biased doctor blade 100 pressed into resilient engagement with the belt over the mixer hopper 40 by a spring loaded level means shown generally as 101 pivoted from the mixer hopper 40. Adjacent to the doctor blade 100 a rotary brush 103 also overlying the mixer hopper 40 further mechanically cleans comestible material from the belt 3.

Figure 18:
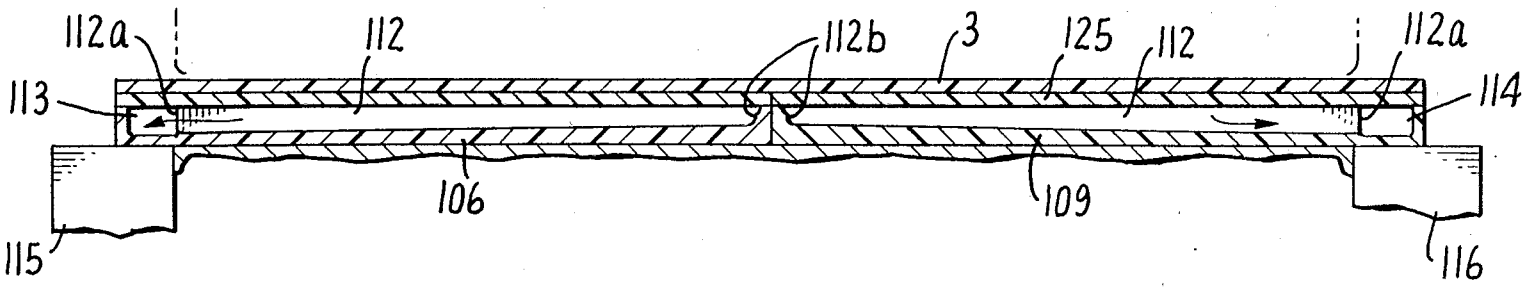
FIG. 18 is a sectional view of the bed taken along line 18—18 of FIG. 16.
Figure 19:
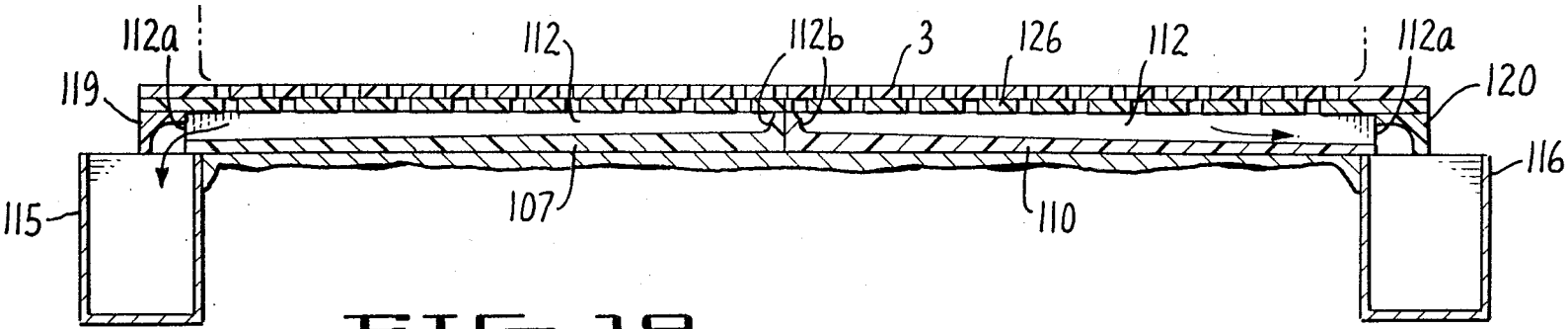
FIG. 19 is a sectional view of the bed taken along side line 19—19 of FIG. 16.
Figure 20:
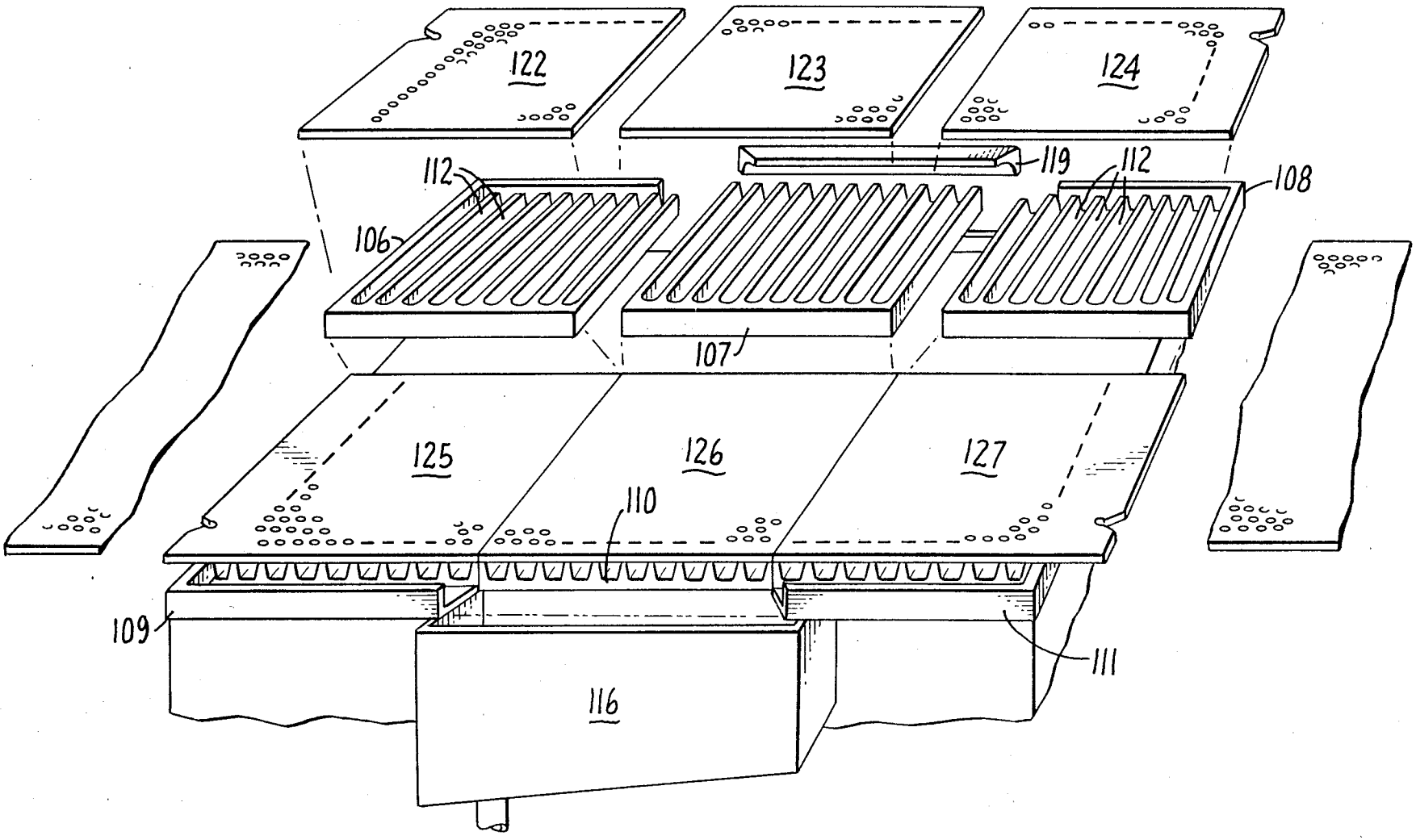
FIG. 20 is an exploded view of the bed in FIG. 15 showing its segmented construction.

FIGS. 15–20 illustrate a press having an improved stationary platen 2'. All other features of the press are essentially the same as those described in connection with the press shown in FIGS. 1–14. Referring more particularly to FIGS. 16–20, the stationary platen 2' comprises a support grid 105 formed from a plurality of sections 106, 107, 108, 109, 110 and 111. Each section cooperates with the other sections to define a horizontal supporting surface interrupted by parallel troughs 112, each trough extending from an open end **112*a* (to the side of the horizontal supporting surface) to a closed end 112*b* (near the center of the platen). Sections 106, 107 and 108 collect juices extracted from beneath the press to the left of center (viewed as shown in FIGS. 18 and 19), and sections 109, 110 and 111** collect the juices to the right of center.

In a preferred construction the supporting grid 105 may be made of nylon and the troughs formed therein are approximately 1 inch in width, ½ to 1 inch in depth, and separated from adjacent troughs by a supporting surface of approximately ½ inch. The bottom surface of each trough inclines downward from the closed end **112*b* towards its open end 112*a***.

Referring to FIG. 18, troughs 112 of sections 106 and 109 fluidly communicate with integrally formed manifolds 113 and 114, respectively. Manifold 113, in turn, fluidly communicates with a container 115 disposed to one side of the support grid. Similarly, manifold 114 fluidly communicates with a container 116 located to the opposite side of the support grid.

The construction of sections 108 and 112 are the mirror image of sections 106 and 109. Section 108 is formed with a manifold 117 which communicates with container 115 and section 111 is formed with a manifold 118 that communicates with container 116.

Troughs 112 of center sections 107 and 110, like the troughs of other sections, are closed at ends **112*b* near to center of the platen but the side ends 112*a* open directly over containers 115 and 116, respectively. A pair of hoods 119 and 120** shield the open ends of the troughs formed in these sections, directing the juice flow downward into the containers.

Stationary platen 2' further comprises a drain panel 121. This drain panel is sectionalized to correspond with the sections of grid 105 and comprises left hand sections 122, 123, 124 and right hand sections 125, 26, 127. The drain panel is supported upon the horizontal supporting surface of grid 105 and the sections are held together in edge to edge relation by four corner pins 128 and locator slots 129, 130, 131, 132 formed in sections 106, 108, 109, 111, respectively.

The construction details of platen 2' affords distinct advantages over other platen constructions. Support grid 105 provides means for rapidly removing expressed fluids, and the sectionalized construction of both the grid and drain panel enhances cleaning. But, in addition, the removal and collection of expressed fluids occurs in a comparatively small space that is essentially enclosed. This results in far less opportunity for an oxidation of expressed juices.

The foregoing embodiments and their modes of operation are described for illustrative purposes only. Various modifications will be apparent to those familiar with the pertinent press technology within the scope of the invention defined in the following claims.

What is claimed is:

1. In a press for extracting juice from comestible solids and semi-solids such as fruits and vegetables, a support structure comprising a support grid formed with a plurality of parallel troughs, a container, and a manifold for conveying extracted juices from one end of each trough to said container, said support grid being sectionalized and comprising left and right hand sections that cooperate to define a horizontal supporting surface interrupted by parallel troughs, each trough being open to the side of the horizontal supporting surface and closed at the opposite end, the left hand sections discharging juices to the left side of the horizontal supporting surface and the right hand sections discharging juices to the right side of the horizontal supporting surface.

2. The apparatus of claim 1, and further comprising a sectionalized perforated drain panel supported upon the horizontal supporting surface of said support grid.

3. The apparatus of claim 1, said manifold being integrally formed with sections of said support grid and in fluid communication with the open end of each trough formed in those sections, one end of said manifold being closed and the other end being in fluid communication with said container.

4. The apparatus of claim 1, each trough having a bottom surface inclined downward from a closed end toward an open end that fluidly communicates with said manifold.

5. In a press for extracting juice from comestible solids and semi-solids and having a stationary platen, a juice pervious belt for carrying comestible material, a feeder for depositing comestible material upon the belt for pressing, means for moving the belt to position the comestible material over said stationary platen, a pressing platen movable into pressing relation to the stationary platen, and means for collecting juice from beneath the stationary platen in a container, the improvement wherein said stationery platen comprises a support grid formed with a plurality of parallel troughs that extend transversley relative to belt movement, and a manifold for conveying extracted juices from one end of each trough to a container, said support grid being sectionalized and comprising left and right hand sections that cooperate to define a horizontal supporting surface interrupted by parallel troughs, each trough being open to the side of the horizontal supporting surface and closed at the opposite end, the left hand sections discharging juices to the left side of the horizontal supporting surface and the right hand sections discharging juices to the left side of the horizontal surface.

6. The apparatus of claim 5, said manifold being integrally formed with sections of said grid and in fluid communication with the open end of each trough formed in those sections, one end of said manifold being in fluid communication with a container.

* * * * *

UNITED STATES PATENT OFFICE

CERTIFICATE OF CORRECTION

Patent No. 4,586,430 Dated May 6, 1986

Inventor(s) Oldrich J. Tichy and Konrad E. Meissner

It is certified that error appears in the above-identified patent and that said Letters Patent are hereby corrected as shown below:

Column 4, line 64, change "51" to read -- "41" --

Column 6, line 30, change "26" to read -- "126" --

Signed and Sealed this

*Fifth* Day of *August 1986*

[SEAL]

*Attest:*

DONALD J. QUIGG

*Attesting Officer*

*Commissioner of Patents and Trademarks*

UNITED STATES PATENT OFFICE

CERTIFICATE OF CORRECTION

Patent No. 4,586,430 Dated May 6, 1986

Inventor(s) Oldrich J. Tichy and Konrad E. Meissner

It is certified that error appears in the above-identified patent and that said Letters Patent are hereby corrected as shown below:

Column 8, line 13, change "left" to read -- right --

Signed and Sealed this

Fourteenth Day of October, 1986

[SEAL]

*Attest:*

DONALD J. QUIGG

*Attesting Officer*

*Commissioner of Patents and Trademarks*